US005089671A

United States Patent [19]

Ranetkins

[11] Patent Number: 5,089,671

[45] Date of Patent: Feb. 18, 1992

[54] UNDERWATER ZOOM SWITCH

[76] Inventor: Val Ranetkins, 135 Seigniory Ave., Pointe Claire, Quebec, Canada

[21] Appl. No.: 451,511

[22] Filed: Dec. 15, 1989

[51] Int. Cl.[5] ..... H01H 13/70; H01H 9/00

[52] U.S. Cl. ..... 200/5 A; 200/83 N; 200/512; 200/302.2

[58] Field of Search ..... 200/5 R, 5 A, 83 B, 200/83 C, 83 N, 61.53, 503, 515, 512, 302.2

[56] References Cited

U.S. PATENT DOCUMENTS

| | | | |
|---|---|---|---|
| 2,413,102 | 12/1946 | Ebert et al. | 264/38 |
| 2,485,857 | 10/1949 | Bower | 55/82 |
| 2,487,433 | 11/1949 | Gardenhour | 200/502 |
| 3,154,087 | 10/1964 | Beaver | 137/15 |
| 3,567,881 | 3/1971 | Duimstra et al. | 200/503 X |
| 3,631,439 | 12/1971 | Nichols | 200/83 D |
| 3,784,768 | 1/1974 | Hunt | 200/52 R |
| 3,864,024 | 2/1975 | Olson | 350/357 |
| 4,017,848 | 4/1977 | Tannas, Jr. | 341/34 |
| 4,046,975 | 9/1977 | Seeger, Jr. | 200/515 |
| 4,066,855 | 1/1978 | Zenk | 200/5 A |
| 4,109,118 | 8/1978 | Kley | 200/5 E |
| 4,421,958 | 12/1983 | Kameda | 200/5 A |
| 4,456,798 | 6/1984 | Iwai et al. | 200/515 X |
| 4,520,248 | 5/1985 | Woelfel | 200/514 |
| 4,524,256 | 6/1985 | Miyata et al. | 200/86 R |
| 4,689,879 | 9/1987 | Fowler | 29/622 |
| 4,947,461 | 8/1990 | Yoshioka et al. | 200/515 |

FOREIGN PATENT DOCUMENTS

| | | |
|---|---|---|
| 2370348 | 6/1978 | France . |
| WO81/00787 | 3/1981 | PCT Int'l Appl. . |

OTHER PUBLICATIONS

IBM Technical Disclosure Bulletin, vol. 14, No. 8, Jan. 1972; R. C. Easton, "Hydraulically Controlled Keyboard Interlock Mechanism", p. 2540.

IBM Technical Disclosure Bulletin, vol. 13, No. 3, Aug. 1970; S. D. Cook et al., "Key Matrix Using a Fluid Medium", p. 744.

*Primary Examiner*—J. R. Scott

*Attorney, Agent, or Firm*—Chilton, Alix & Van Kirk

[57] ABSTRACT

Conductive pads are disposed in a housing which consists of a degassed, non-compressible, electrically insulating fluid. One of the pads is mounted on the underside of a push-button, and the push-button is surrounded by a flexible membrane which closes one end of the housing. When the push-button is pressed, the fluid between the conductive pads is displaced, and the membrane stretches sufficiently to accommodate the displaced fluid.

7 Claims, 1 Drawing Sheet

UNDERWATER ZOOM SWITCH

BACKGROUND OF INVENTION

1. Field of the Invention

The invention relates to an all pressure switch. More specifically, the invention relates to such a switch which includes a housing member having a recessed well for holding a degassed, non-compressible, electrically insulating fluid spacer.

The invention also relates to a control module including such all pressure switches.

The invention also relates to a process for making such all pressure switches.

2. Description of Prior Art

It is known in the prior art to provide switches, or other like devices, having spacers made of a liquid or other fluid or a solid material. Such switches or other devices are described in the following patents: U.S. Pat. No. 4,017,848, Tannas, Jr., Apr. 12, 1977; U.S. Pat. No. 3,784,768, Hunt, Jan. 8, 1974; IBM Technical Disclosure Bulletin, Vol. 14, No. 8, Jan. 1972; U.S. Pat. No. 4,524,256, Miyata et al, June 18, 1985; U.S. Pat. No. 2,487,433, Gardenhour, Nov. 8, 1949; U.S. Pat. No. 4,689,879, Fowler, Sept. 1, 1987; French Patent No. 2,370,348, Leveille, June 1978; U.S. Pat. No. 4,109,118, Kley, Aug. 22, 1978; WO 81/00787, Marshall, Mar. 19, 1981; U.S. Pat. No. 3,864,024, Olson, Feb. 4, 1975; IBM Technical Disclosure Bulletin, Vol. 13, No. 3, Aug. 1970; U.S. Pat. No. 4,421,958, Kameda, Dec. 20, 1983; U.S. Pat. No. 4,066,855, Zenk, Jan. 3, 1978; and U.S. Pat. No. 4,520,248, Woelfel, May 28, 1985.

The above references are discussed below:

In U.S. Pat. No. 4,017,848, a switch array comprises an upper electrode and a lower electrode separated from each other by a transparent dielectric fluid. The electrodes are also transparent so that a legend can underlie the switch. As the switch operates at atmospheric pressure, there is no teaching of using a degassed fluid.

In U.S. Pat. No. 3,784,768, a submersible touch operated signaler includes a front plate and a rear plate—both of which are of a conductive material and grounded—and an intermediate plate—also of a conductive material and connected to a source of low voltage. The plates are spaced from each other and the entire arrangement is submersible in, for example, a swimming pool. When submersed, water from the pool flows into the regions between the plates (see column 4, lines 10 et seq. of the patent).

In IBM Technical Disclosure Bulletin, Vol. 14, No. 8, January 1972, a hydraulically controlled keyboard comprises fluid chambers 2 underlying switch actuator 6 housing. The chambers are connected by a channel 3. Fluid is contained in the chambers and channel. As the switch mechanism is disposed in the switch actuator housing, the fluid does not need to be an insulating fluid. As the mechanism is operated at atmospheric pressure, the fluid does not have to be degassed.

In U.S. Pat. No. 4,524,256, a pressure sensitive switch comprises a conductive porous material spaced from a conductive layer by an elastic insulator. The elastic insulator not being a fluid, the switch of the plastic does not include an insulating, degassed fluid spacer.

In U.S. Pat. No. 2,487,433, a ball contactor switch comprises a conductive ball 23 in a fluid filled tubular container 10. There are, of course, substantive differences between the present invention and the teaching of this patent.

In U.S. Pat. No. 4,689,879, a membrane keyboard has two circuit layers with spacers disposed between them. Vents are provided to permit the escape of trapped air.

In French Patent 2,370,348, a keyboard for a pocket calculator includes a flexible foil 18 having conductive discs. The flexible foil is spaced from a set of broken paths 15 by a compressible fluid 20.

In U.S. Pat. No. 4,109,118, there is taught an array of manually operable key switches in which each switch comprises a fluid filled bag under a key cap. The fluid does not have to be an insulator, nor is there any teaching in the patent that the fluid be degassed.

In WO 81/00787, a switch structure uses, e.g., a displaceable fluid to provide a degree of resilient resistance.

In U.S. Pat. No. 3,864,024, an optical display device includes a transparent layer 1, an overlying layer 2 and a liquid 3 between layers 1 and 2.

In IBM Technical Disclosure Bulletin, Vol. 13, No. 3, August 1970, a switch has a conductive strip 12 mounted on a substrate 10. A cover 14 overlies the substrate and includes a metallic contact 14B. A liquid 20 separates 12 from 14B. There is no teaching of degassing the fluid.

In U.S. Pat. No. 4,421,958, a membrane switch includes conductive layers 1 and 5 which are mounted on substrates 2 and 6 respectively and are separated by air. The substrates are spaced by a porous sheet 12 so that air can be brought into and discharged from the space between the conductive layers.

In U.S. Pat. No. 4,066,855, there is taught a vented membrane switch. It uses the same principles as the '958 patent except that there is provided a vent in the main membrane to permit airflow.

In U.S. Pat. No. 4,520,248, a keyboard assembly includes conductive strips 20 and 28 which are spaced by an insulating strip 22.

The prior art also teaches degassing machines as illustrated in U.S. Pat. Nos. 2,413,102, 2,485,857 and 3,154,087.

With respect to switches having fluid spacers, if there is gas in the fluid, then the switches will have difficulties at either extreme of pressure, i.e, at high pressures or at low pressures. At high pressures, the gas will be compressed so that contact may be made when it is not desired. At low pressures, the gas will expand making the switch difficult to operate or possibly even bursting the switch depending on the amount of gas in the fluid.

SUMMARY OF INVENTION

It is therefore an object of the invention to provide a switch which overcomes the disadvantages of the prior art.

It is a more specific object of the invention to provide a switch having a fluid spacer wherein the fluid is degassed.

It is a further object of the invention to provide control modules utilizing a plurality of the inventive switches.

It also an object of the invention to provide a process for degassing the fluid in the inventive switches.

In accordance with the invention there is provided an all pressure switch, comprising:

a housing member having a recessed well for holding a degassed, non-compressible, electrically insulating fluid, said housing further including a first end;

flexible membrane means covering said first end;

a surface within said housing having at least one conductive pad facing said flexible membrane; and a second conductive pad on the underside of said flexible membrane and in alignment with said one conductive pad;

whereby, when said flexible membrane is depressed in the area above said second conductive pad, the fluid between said second conductive pad and said one conductive pad will be displaced in a direction away from the space between said second conductive pad and said one conductive pad so that said second conductive pad will make contact with said one conductive pad, said flexible membrane being expanded to provide additional volume to accommodate said displaced fluid, said additional volume being equal to the volume of said displaced fluid.

Further in accordance with the invention there is also provided a control module including a plurality of said all pressure switches.

Still further in accordance with the invention there is provided a process for the degassing of a non-compressible, electrically insulating fluid in a all pressure switch which switch comprises a housing member having a recess for holding said fluid, said housing member further having a first end covered by a flexible membrane means, said housing still further including at least one fluid filling and degassing valve;

said process comprising:

filling a vacuum chamber with said fluid; submerging said housing member into said fluid, with said valve open, until said housing is fully covered by said fluid;

whereby said housing will be filled with said fluid;

drawing a vacuum on said vacuum chamber whereby to withdraw all gas from said fluid;

breaking said vaccum and closing said valve while said housing member is submerged;

whereby said housing member is filled with degassed fluid.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
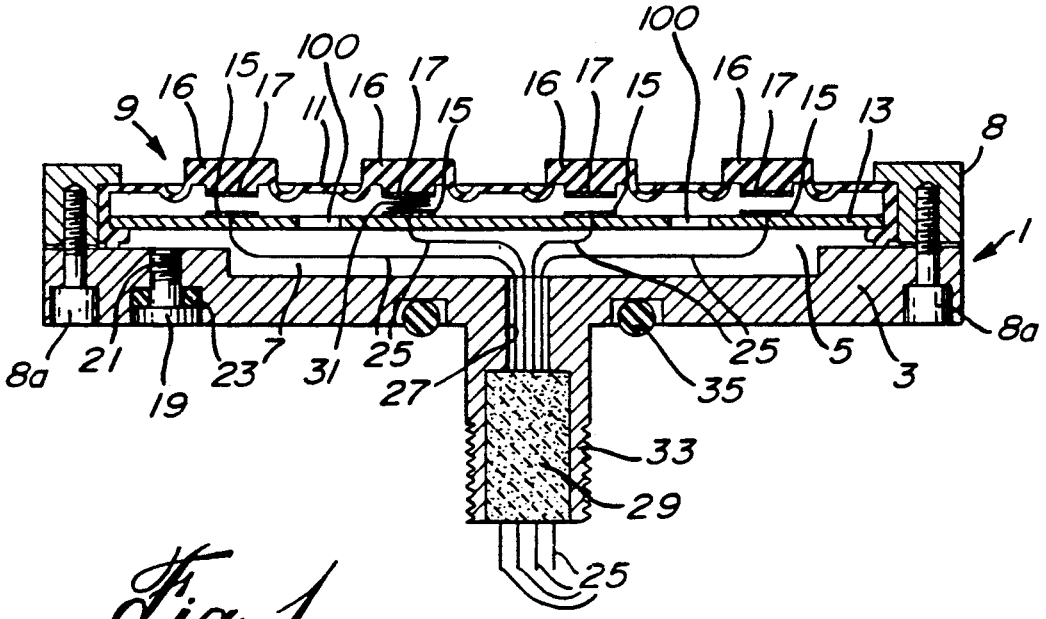
FIG. 1 is a section through I—I of FIG. 2.

Referring to FIG. 1, a control module, containing a plurality of inventive switches, is illustrated generally at 1 and includes a housing 3. A recess 5 in the housing includes a degassed, non-compressible, electrically insulating fluid which, in accordance with the invention, is degassed, as will be described below. Although many insulating fluids are suitable for use in the invention, in accordance with a preferred embodiment, the insulating fluid comprises a silicone fluid.

The housing is further formed with a sealing cover 8 secured to member 3 by screws 8*a*. The securing must be done by leak-proof connections so that gas cannot enter into the housing.

The sealing cover has a first end 9 which is covered by a flexible membrane 11. Examples of useful materials for forming the flexible membrane are rubber, flexible metal or flexible plastic. The flexible membrane is disposed over the one end in a leak-proof arrangement.

Disposed in the housing is a board 13 on whose top surface are conductive coatings 15 forming conductive pads. Disposed on the underside of the flexible membrane are conductive pads 17 each of which is in alignment with a respective one of the conductive pads 15. The conductive pads 17 underlie push-button moldings 16.

A filling and degassed fluid valve 19 is used for filling the housing with fluid, and for degassing the fluid in the housing, and for subsequently sealing the degassed fluid in the housing. In the illustrated embodiment, the valve 19 comprises a threaded opening with screw 21, having mating screw threads, screwable into the opening. O-ring 23 ensures a leak-proof closure. Although only one such valve is illustrated in FIG. 1, preferably, the housing includes two such valves.

Openings 100 in the board 13 permit the degassed fluid 19 to move from the area below the board to the area above the board and vice-versa.

As is well known in the art, conductive leads 25 may be attached to conductive pads 17. The leads are then fed to an opening 27 which is leak-proofedly sealed with a seal 29. The conductive leads would extend through the seal 29 and emerge from the other end thereof as shown in FIG. 1.

In operation, when it is desired to depress a switch, the push-button molding is pushed downwardly. The fluid between the conductive pads 15 and 17 will then be displaced. The displaced fluid will force the flexible membrane outwardly to bulge out by an increased volume equal to the volume of the displaced fluid. When the switch is released, the flexible membrane will return to its original shape thus returning the displaced fluid to the space between the conductive pads 15 and 17.

If the fluid is a slow moving fluid, to increase the speed of the return action of the switch, a spring, as illustrated at 31, may be inserted between the conductive pads 15 and 17. Obviously, either the entire spring would be insulated or there would be insulated pads between the spring and the conductive pads so that a conductive circuit is not formed between the conductive pads 15 and 17 and the spring 31.

The module can then be mounted on a device, for example, an underwater camera, by screwing screw 33 into a threaded opening, with mating screw threads, on the underwater camera. O-ring 35 will once again provide a leak-proof seal between the module and the camera. The conductive leads 25 will, as well known in the art, be connected to appropriate elements of the underwater camera.

In a process for degassing the insulating fluid, a vacuum chamber is filled with the fluid to a level deep enough so that the entire module can be submerged therein. The module, with the valve or valves 19, in the open position, is then submerged in the fluid so that it is completely covered. A vacuum is then drawn whereupon all of the gas will be drawn out of the fluid, and especially the fluid in the housing. The vacuum is then broken, and, while the module is still submerged in the fluid, the valve is closed. In the case of the illustrated embodiment, screw 21 is inserted into the threaded opening and screwed tightly shut.

The module is then removed from the fluid and the fluid in the housing will be completely degassed.

Figure 2:
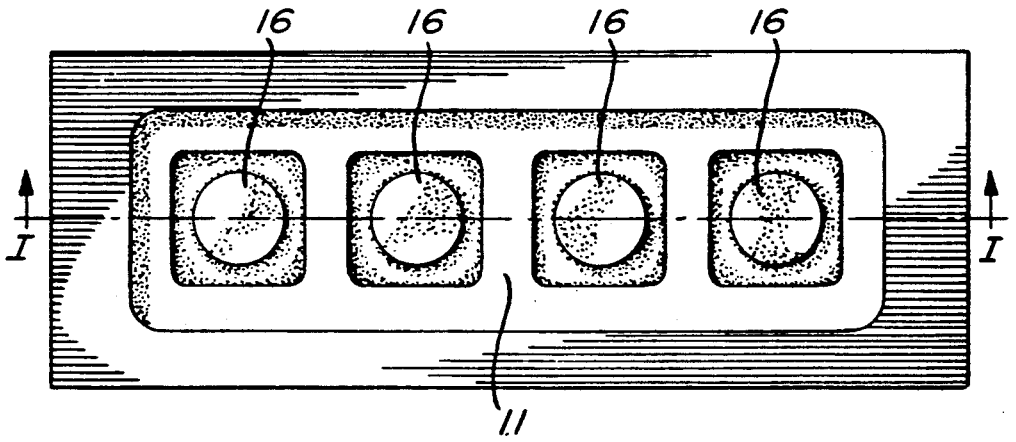
FIG. 2 is a top view of a control module in accordance with the invention.

Although FIGS. 1 and 2 herein illustrate a module having a plurality of switches, it will be quite clear that the switches can be formed as single units, and the single unit switches can then be mounted in a module.

Alternatively, a single unit switch may be used on its own.

Although only one embodiment has been described, this was for the purpose of illustrating, but not limiting, the invention. Various modifications, which will come readily to the mind of one skilled in the art, are within the scope of the invention as defined in the appended claims.

I claim:

1. A switch arrangement, comprising:

a housing having an open end and a closed end to define an interior chamber;

a degassed, non-compressible, electrically insulating fluid completely filling said interior chamber;

a flexible, stretchable membrane covering said open end of said housing, said flexible membrane having an inner surface, facing said closed end of said housing, and an opposed outer surface;

a push-button molding formed on said outer surface of said flexible membrane;

wherein, when said push-button molding is not depressed, said switch arrangement is in an open state, and, when said push-button molding is depressed in the direction towards said closed end of said housing, said switch arrangement is in a closed state; and wherein, when said push-button molding is depressed in the direction toward said closed end of said housing, the fluid under said membrane in the area of said push-button molding is displaced in a direction away from the space between said push-button molding and said closed end, said flexible membrane being expanded in the area surrounding said push-button molding to provide additional volume to accommodate said displaced fluid, said additional volume being equal to the volume of said displaced fluid.

2. A switch as defined in claim 1 wherein said housing further comprises a valve through which said chamber is filled with said fluid and for degassing said fluid.

3. A switch as defined in claim 2 wherein said flexible membrane comprises a rubber material.

4. A switch as defined in claim 2 wherein said flexible membrane comprises a flexible plastic material.

5. A switch as defined in claim 2 wherein said flexible membrane comprises a flexible metal material.

6. A switch as defined in any one of claims 3, 4 or 5 and including a spring under said push-button molding.

7. A control unit comprising a plurality of switch arrangements, each said switch arrangement comprising:

a housing having an open end and a closed end to define an interior chamber;

a degassed, non-compressible, electrically insulating fluid completely filling said interior chamber;

a flexible, stretchable membrane covering said open end of said housing, said flexible membrane having an inner surface, facing said closed end of said housing, and an opposed outer surface;

a push-button molding formed on said outer surface of said flexible membrane;

wherein, when said push-button molding is not depressed, said switch arrangement is in an open state, and, when said push-button molding is depressed in the direction towards said closed end of said housing, said switch arrangement is in a closed state; and wherein, when said push-button molding is depressed in the direction toward said closed end of said housing, the fluid under said membrane in the area of said push-button molding is displaced in a direction away from the space between said push-button molding and said closed end, said flexible membrane being expanded in the area surrounding said push-button molding to provide additional volume to accommodate said displaced fluid, said additional volume being equal to the volume of said displaced fluid.

* * * * *